US010476176B2

(12) United States Patent
De Deken et al.

(10) Patent No.: US 10,476,176 B2
(45) Date of Patent: Nov. 12, 2019

(54) MINIATURE ELECTRICAL CONTACT OF HIGH THERMAL STABILITY

(71) Applicant: AXON CABLE, Montmirail (FR)

(72) Inventors: Leen De Deken, Montmirail (FR); Ning Yu, Villeneuve le Comte (FR); Bastien Brocard, Saint Martin d'ablois (FR)

(73) Assignee: AXON CABLE, Montmirail (FR)

( * ) Notice: Subject to any disclaimer, the term of this patent is extended or adjusted under 35 U.S.C. 154(b) by 0 days.

(21) Appl. No.: 15/307,590

(22) PCT Filed: Apr. 24, 2015

(86) PCT No.: PCT/FR2015/051125
§ 371 (c)(1),
(2) Date: Oct. 28, 2016

(87) PCT Pub. No.: WO2015/166174
PCT Pub. Date: Nov. 5, 2015

(65) Prior Publication Data
US 2017/0077617 A1 Mar. 16, 2017

(30) Foreign Application Priority Data
Apr. 29, 2014 (FR) ..... 14 53882

(51) Int. Cl.
*C22C 19/05* (2006.01)
*H01R 4/12* (2006.01)
(Continued)

(52) U.S. Cl.
CPC ..... *H01R 4/12* (2013.01); *C22C 19/051* (2013.01); *C22C 19/055* (2013.01);
(Continued)

(58) Field of Classification Search
CPC ..... H01R 13/03; H01R 13/08; H01R 13/33; H01R 13/052; H01R 4/12; H01B 1/02;
(Continued)

(56) References Cited

U.S. PATENT DOCUMENTS 3,255,430 A 6/1966 Phillips
3,319,217 A 5/1967 Phillips
(Continued)

FOREIGN PATENT DOCUMENTS

WO 8203140 9/1982
WO WO 2011109396 A1 * 9/2011 ..... H01R 12/523

OTHER PUBLICATIONS

Advanced Interconnect Axon Solutions, Axon' Cable launches extremely non-magnetic micro-D connectors, Nov. 25, 2013, Axon' Cable. http://www.axon-cable.com/en/05_news/01_news/00/consultNews.aspx?id_news_detail=91.*
(Continued)

*Primary Examiner* — Edwin A. Leon
*Assistant Examiner* — Milagros Jeancharles
(74) *Attorney, Agent, or Firm* — Hamre, Schumann, Mueller & Larson, P.C.

(57) ABSTRACT

The present invention relates to a male electrical contact of twist-pin type comprising an electrical terminal formed by a bundle comprising three central strands made of nickel or made of copper and 7 peripheral strands made of Ni—Cr—Ti—Al alloy and a bulge in the central portion, it being possible for said alloy to optionally additionally comprise Co and/or Mo. It also relates to the use of this contact in a micro-D connector, advantageously for applications at a service temperature ≤260° C.

18 Claims, 6 Drawing Sheets

Figure 1:
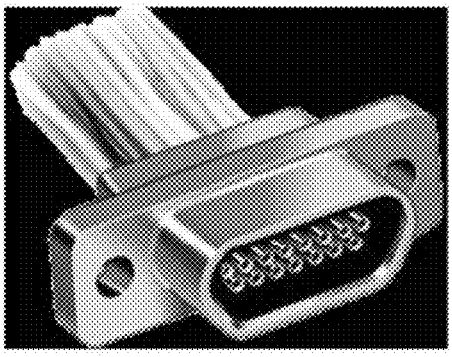

(51) Int. Cl.
*H01R 13/03* (2006.01)
*H01B 1/02* (2006.01)

(52) U.S. Cl.
CPC ..... *C22C 19/056* (2013.01); *C22C 19/058* (2013.01); *H01B 1/02* (2013.01); *H01R 13/03* (2013.01)

(58) Field of Classification Search
CPC ... C22C 19/051; C22C 19/055; C22C 19/056; C22C 19/058; Y10S 439/93
USPC ..... 439/75, 775; 174/102 R, 106 R, 108, 174/113, 126.1, 128.1, 128.2; 428/544–687
See application file for complete search history.

(56) References Cited

U.S. PATENT DOCUMENTS 3,402,466 A 9/1968 Phillips
3,790,372 A * 2/1974 Chaturvedi ..... C22C 19/058 148/419
4,358,180 A 11/1982 Lincoln
4,857,233 A * 8/1989 Teichmann ..... B22F 1/025 252/512
4,943,245 A * 7/1990 Lincoln ..... H01R 24/44 439/578
5,051,108 A * 9/1991 Lincoln ..... H01R 13/20 439/825
5,106,310 A * 4/1992 Krajewski ..... H05K 3/368 439/75
5,112,232 A * 5/1992 Cray ..... H01L 21/4853 257/E21.518
5,659,152 A * 8/1997 Horie ..... H01B 11/04 174/113 R
5,888,316 A * 3/1999 Erickson ..... C22C 19/056 148/410
5,969,229 A * 10/1999 Hori ..... H01B 7/0009 174/126.2
6,039,325 A * 3/2000 Steinetz ..... F16J 15/0812 277/528
6,472,801 B1 * 10/2002 Matsubara ..... H01T 13/52 313/141
6,584,677 B2 * 7/2003 Garcia ..... H01R 43/28 29/605
6,729,026 B2 * 5/2004 Garcia ..... H01R 43/28 29/33 F
6,750,597 B1 * 6/2004 Sakura ..... H01T 13/20 313/141
7,909,668 B2 * 3/2011 McAlonis ..... H01R 12/585 439/701
8,092,246 B1 * 1/2012 Santiago ..... H01R 13/6275 439/357
9,093,194 B2 * 7/2015 McCullough ..... H01B 7/14
9,583,884 B1 * 2/2017 Wang ..... H01R 13/6485
2004/0192155 A1 * 9/2004 Taniguchi ..... H01T 21/02 445/70
2006/0096672 A1 * 5/2006 Burgermeister ..... C22C 19/051 148/419
2008/0191596 A1 * 8/2008 King ..... A61B 17/225 313/165
2010/0022137 A1 * 1/2010 McAlonis ..... H01R 12/585 439/638
2010/0055990 A1 * 3/2010 Madeley ..... H01R 13/187 439/675
2013/0104392 A1 5/2013 Morikawa
2014/0076606 A1 * 3/2014 Patel ..... H01B 3/445 174/102 A
2014/0271337 A1 * 9/2014 Banik ..... B21J 1/06 420/448
2015/0027598 A1 * 1/2015 Seng ..... A61L 31/022 148/578

OTHER PUBLICATIONS

Waspaloy RA.pdf Rolled Alloys, Inc. https://www.rolledalloys.com/alloys/cobalt-alloys/waspaloy/en/ Copyright 2011 Rolled Alloys Bulletin No. 1001USe Jul. 2012.*
WASPALOY_DS_US_EN.pdf https://www.rolledalloys.com/shared-content/technical-resources/datasheets/WASPALOY_DS_US_EN.pdf Copyright 2011 Rolled Alloys Bulletin No. 1001USe Jul. 2012.*
"Nimonic 90—Composition, Properties and Applications of Nimonic 90 Nickel-Chromium-Cobalt Alloy by Alloy Wire International"; Alloy wire International, 2013, pp. 1-5, XP-002734759, http://www.azonano.com/article.aspx? ArticleID=4199.
"Nimonic alloy 80A"; Special Metal Corporation, 2004, pp. 1-23, XP002734760, http://www.specialmetals.com/.
"Nicrofer 7016 TiAl—allow 751"; Material Data Sheet No. 4047, ThyssenKrupp VDM, 2005, pp. 1-10, www.thyssenkruppvdm.com.
International Search Report issued in International Application No. PCT/FR2015/051125 dated Aug. 4, 2015 (7 pages).
Written Opinion issued in International Application No. PCT/FR2015/051125 dated Aug. 4, 2015 (5 pages).

* cited by examiner

MINIATURE ELECTRICAL CONTACT OF HIGH THERMAL STABILITY

The present invention relates to the field of electrical contacts of Twist-Pin type (Twist-Pin technology) of high thermal stability that can be used in connectors of the micro-D family according to the Mil-DTL-83513 standard.

In the interest of making the interconnection of electronic systems more compact, the density of connection points increasingly becomes a desired performance, which has led to miniaturizing not only the transmission cable, but also the connector.

The Mil-DTL-83513 standard defines a family of male and female rectangular connectors, the connecting portions of which have a D shape. This family, referred to as the micro-D family, is characterized by a pitch of 1.27 mm, the pitch representing the center-to-center distance between any 2 adjacent connection points.

The standard also explicitly defines the number of connection points (or the number of contacts) which are respectively 9, 15, 21, 25, 31, 37, 51 and 100. These contacts are positioned in the connector in 2 or 3 rows (FIG. 1).

The micro-D series of connectors have begun to appear massively on the electronic connection market over the last few years.

In a connector in general, a particular design guarantees a retention between each pair of contacts in addition to the fastening screws.

Figure 2:
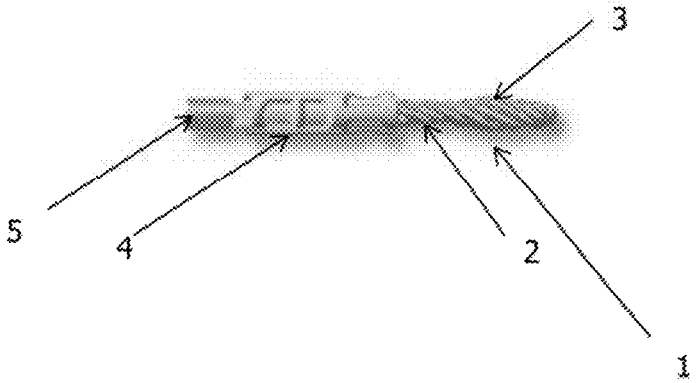

In the case of the micro-D connector, the retention is ensured by the male contact, the female contact being a tube. For this, the technologies used have a bulge which ensures a lateral contact with the tube. One of the technologies is referred to as the Twist-Pin, denoted by TP. This consists in firstly producing a bundle composed of copper and copper-beryllium, and then in crimping it in a tube composed of copper or copper-beryllium (as disclosed for example in U.S. Pat. Nos. 3,255,430, 3,319,217, 3,402,466 and WO82/03140). In this technology, the bulge is produced by a mechanical "bump" operation which makes the peripheral strands of the bundle spread out to a precise degree. The whole of the contact is finally coated electrolytically with a nickel sublayer then with a final layer of gold according to the MIL-G-45204 standard. This male twist-pin contact is schematically illustrated in FIG. 2.

However, this contact cannot be used in applications where the operating temperature is high and in which it is necessary to unmate and remate the connectors between uses. Indeed, due to the insufficient thermal stability of the copper-beryllium, the retention of the contacts is no longer ensured under these conditions. More specifically the bulge zone of the contact suffers from a phenomenon referred to as "creep", losing its characteristic of elasticity, under the actions of heat and of mechanical stress of the female contact, which no longer makes it possible to guarantee a good transmission of the signals. Experimentally, after several hours mated to a female contact at 260° C., the bump of the male contact comes out flattened. This lack of retention results in a drastic increase in the contact resistance as illustrated in example 9 and in contact interruptions and therefore in interruptions in the signal transmitted during shocks or vibrations.

It is therefore necessary to redesign the construction of the Twist-Pin contact for the high-temperature applications thereof in particular so as to obtain a contact capable of holding out at 260° C. for 2000 hours while meeting the main requirements of the Mil-DTL-83513 standard.

Little data is available on the creep behavior of the materials at 260° C. The inventors therefore turned to alloys having good mechanical characteristics and preferably having structural hardening since that often guarantees better mechanical characteristics at temperature. Indeed, the over-tempering temperature is in general higher than the recrystallization temperature. It is also necessary that such materials have a good conductivity in order to be able to be used as an electrical contact and that they can be welded with copper strands.

But these materials have not shown, experimentally, better results than the standard contacts made of copper-beryllium (Cu—Be) at 260° C. (comparative examples 1 to 3: Cu—Be—Co, Cu—Ni—Sn—Mn alloys and Au—Cu—Pt—Ag—Zn bundles).

Ni—Cr—Ti—Al alloys are known from the prior art for being used as high-temperature spring but for extreme temperatures, much greater than the requirements (>700° C.). On the other hand, the use thereof for the transmission of a current is not obvious. Indeed, they have a limited electrical conduction (of the order of 1-2% IACS). This does not therefore facilitate the use thereof as an electrical contact. In addition, it was not obvious that it would be possible to obtain contacts with a contact resistance that meets the limiting value given by the Mil-DTL-83513 standard. In particular, it was not obvious to be able to produce the copper strands—Ni—Cr—Ti—Al weld.

Yet, surprisingly, the inventors have discovered that it was possible to obtain contacts capable of holding out at 260° C. for 2000 hours while meeting the main requirements of the Mil-DTL-83513 standard with the aid of a bundle of the electrical terminal of the male contact comprising (in particular formed by) 3 central strands made of Ni or Cu and 7 peripheral strands made of Ni—Cr—Ti—Al alloy.

The present invention therefore relates to a male electrical contact of twist-pin (TP) type comprising an electrical terminal formed by a bundle comprising (advantageously formed by) three central strands made of nickel (Ni) or made of copper (Cu) and 7 peripheral strands made of Ni—Cr—Ti—Al alloy and a bulge (or bump) in the central portion, it being possible for said alloy to optionally additionally comprise Co and/or Mo.

Within the meaning of the present invention, the expression "electrical contact" is understood to mean a part or assembly of parts, capable of being fastened to one end of a conductive element, in order to ensure an electrical contact between this conductive element and another conductive element. This "other conductive element" is generally also an electrical contact.

The female contact may simply have the shape of a tube.

The male contact is generally essentially formed by a contact electrical terminal (male or female conductive part) and a conductive joining part (or simply referred to as "the joint") to which the terminal is mechanically and electrically fastened, the joint also being arranged so as to be able to be mechanically and electrically fastened to a conductive element.

The expression "conductive element" here broadly targets any body, at least one portion of which is electrically conductive; it may in particular be an electrical wire, or else a contact terminal.

The term "terminal" or "contact terminal" here denotes a part (or a portion of a part) intended to be in contact with another part (another terminal) so as to establish an electrical contact.

Within the meaning of the present invention, the expression "male electrical contact of twist-pin type" is understood to mean any male electrical contact according to the present invention using Twist-Pin (or TP) technology.

In this technology, the manufacture of a female contact consists simply in producing a tube, by high-precision turning.

The manufacture of a male contact itself comprises three steps: firstly a first conductive element that is an electrical terminal formed by a bundle comprising one or more central strands (in the case of the present invention, 3 central strands) and peripheral strands (in the case of the present invention, 7 peripheral strands), and having a bulge (referred to as a bump) in the central portion, is manufactured (in this technology, the bulge is produced by a mechanical "bump" operation which makes the outer strands of the bundle spread out to a precise degree); a tube is manufactured by a high-precision turning operation, identical to the manufacture of the female contact; the bundle is fastened in one end of the tube.

This technology is for example illustrated by patent U.S. Pat. No. 4,358,180.

As illustrated in FIG. 2, the male electrical contact 1 according to the present invention therefore comprises a bundle 2 provided with a bulge or bump 3 in the central portion, the bundle forming the electrical terminal. This electrical terminal is inserted into a cylinder 4 which is provided with an electrical wire 5.

In one advantageous embodiment, the peripheral strands are helically wound around the central strands of the bundle.

The male electrical contact according to the present invention may therefore be produced by methods well known to a person skilled in the art according to the TP technology.

Thus, within the context of the present invention, the 7 peripheral strands of the bundle are made of Ni—Cr—Ti—Al alloy. This alloy may optionally contain cobalt (Co) and/or molybdenum (Mo). It may thus, for example, be an Ni—Cr—Co—Ti—Al or Ni—Cr—Co—Mo—Ti—Al alloy. Advantageously, it is an Ni—Cr—Co—Ti—Al alloy. This alloy may also contain less than 2%, by weight relative to the total weight of the alloy, of iron (Fe).

In one particular embodiment, the Ni—Cr—Ti—Al alloy essentially consists of (is advantageously formed by), as percentage by weight relative to the total weight of the alloy:

chromium: 15%-25%, advantageously 17%-22%, more particularly 18%-21%, for example 18%-20%;

titanium: 1.5%-3.5%, advantageously 1.7%-3.4%, more particularly 1.8%-3.3%, for example 2%-3%;

cobalt: 0-25%, advantageously 2%-23%;

aluminum: 1%-2%, advantageously 1%-1.8%, more particularly 1.2%-1.6%, in particular 1.4%-1.6%, for example 1.5%;

molybdenum: 0-11%, advantageously 0-10.5%;

nickel: balance, advantageously 50%-80%, more particularly 51%-79.5%, for example 52.6%-79.2%, in particular 53%-60%, more particularly 53%-55%;

and the unavoidable impurities.

In particular, the unavoidable impurities are selected from (as percentage by weight relative to the total weight of the alloy):

Ag (advantageously ≤0.00030%, in particular ≤0.00020%),

B (advantageously ≤0.01%, more advantageously ≤0.02%, in particular ≤0.008%, for example ≤0.00370%), Bi (advantageously ≤0.00004%, in particular ≤0.00003%), C (advantageously ≤0.13%, more advantageously ≤0.1%, in particular ≤0.061%), Cu (advantageously ≤0.5%, more advantageously ≤0.2%, in particular ≤0.02%), Fe (advantageously ≤5%, more advantageously ≤3%, in particular ≤2%, more particularly ≤1.5%, for example ≤1.02%), Mn (advantageously ≤1%, more advantageously ≤0.1%, in particular ≤0.030%), P (advantageously ≤0.03%, more advantageously ≤0.0060%, in particular ≤0.0050%), Pb (advantageously ≤0.0025%, more advantageously ≤0.0020%, in particular ≤0.0003%), S (advantageously ≤0.03%, more advantageously ≤0.015%, in particular ≤0.00040%), Si (advantageously ≤1%, more advantageously ≤0.75%, in particular ≤0.20%, for example ≤0.170%)

and/or Zr (advantageously ≤0.15%, more advantageously ≤0.12%, in particular ≤0.0560%).

More particularly, the impurities are selected from B, Zr, Cu, Fe, S, Si, Mn, C, Pb and/or P.

The overall impurity percentage (relative to the total weight of the alloy) is therefore in general ≤10%, advantageously ≤8%, more advantageously ≤6%, in particular ≤5%, more particularly ≤3%, for example ≤2%.

Advantageously, the content of nickel+cobalt, as percentage by weight relative to the total weight of the alloy, is between 62% and 83%, advantageously between 64.5% and 81.5%, for example 69%-75%.

Advantageously, the alloy comprises cobalt, in particular in a content of between 2% and 23%, by weight relative to the total weight of the alloy, more particularly between 10% and 22%, more particularly still between 12% and 21%, for example between 15% and 21%.

Particularly, the alloy comprises molybdenum, in particular in a content of between 3.5% and 11%, by weight relative to the total weight of the alloy, advantageously between 4% and 10.5%, for example between 9% and 10.5%. This alloy is in particular available commercially from Alloy Wire International under the references Nimonic 80A, Nimonic 90, Waspaloy and Rene 41.

In one particular embodiment of the electrical contact according to the present invention, the three central strands of the bundle are assembled with a pitch of between 1 and 5 mm left, in particular between 1 and 3 mm left, advantageously it is 2 mm left.

In another embodiment, the seven peripheral strands are assembled around the central strands with a pitch of between 1 and 5 mm right, in particular between 1 and 3 mm right, advantageously it is 2.4 mm right.

In yet another embodiment, the three central strands of the bundle are assembled with a pitch of between 1 and 5 mm left, in particular between 1 and 3 mm left, advantageously it is 2 mm left, and the seven peripheral bundles are assembled around with a pitch of between 1 and 5 mm right, in particular between 1 and 3 mm right, advantageously it is 2.4 mm right.

Advantageously, the three central strands of the bundle of the contact according to the present invention have a diameter of between 0.069 and 0.109 mm, in particular between 0.079 and 0.099 mm, advantageously it is 0.089 mm.

Advantageously, the seven peripheral strands of the bundle of the contact according to the present invention have a diameter of between 0.1 and 0.160 mm, in particular between 0.110 and 0.137, advantageously it is 0.127 mm.

In one particularly advantageous embodiment, the three central strands of the bundle of the contact according to the present invention have a diameter of between 0.069 and 0.109 mm, in particular between 0.079 and 0.099 mm, advantageously it is 0.089 mm, and the seven peripheral strands of the bundle of the contact according to the present invention have a diameter of between 0.1 and 0.160 mm, in particular between 0.110 and 0.137 mm, advantageously it is 0.127 mm.

In one advantageous embodiment, the bundle of the contact according to the present invention is coated with an electrolytic gold layer, advantageously having a thickness of between 1 and 6 μm, more advantageously in order to have the maximum contact resistance allowable by the MIL-DTL-83513 standard, of at least 2.6 μm, in particular between 2.6 and 6 μm, more particularly between 2.6 and 2.8 μm, for example of around 2.7 μm.

This coating is produced by processes well known to a person skilled in the art. Indeed, the inventors noticed surprisingly that a 2.6 μm layer of electrolytic gold on the bundle of the contact according to the present invention was sufficient to achieve the contact resistance values given by the MIL-DTL-83513 standard.

Advantageously, the bundle of the contact according to the present invention comprises no sublayer between the alloy and the electrolytic gold.

Indeed, the inventors noticed surprisingly that it was not necessary to apply a sublayer, in particular a nickel sublayer, before the deposition of the gold layer on the bundle in order to achieve the contact resistance values given by the MIL-DTL-83513 standard.

Advantageously, the service temperature of the contact according to the present invention is ≤260° C., advantageously for a service life of at least 2000 hours. Indeed, the inventors noticed that up to and including a temperature of 260° C., the bulge of the central portion of the bundle (or bump) of the contact according to the present invention did not undergo a creep phenomenon, even after at least 2000 hours of use by insertion into a female contact. Connections and disconnections are therefore possible between the uses without loss of retention. The minimum separation force defined in the MIL-DTL-83513 standard is thus met even after aging. There is therefore no risk of contact interruption and therefore interruption in the signal transmitted at these temperatures during shocks or vibrations.

The present invention therefore also relates to the use of the male electrical contact according to the present invention in a micro-D connector, advantageously for applications at a service temperature ≤260° C.

Within the meaning of the present invention, the expression "micro-D connector" is understood to mean any connector governed by the MIL-DTL-83513 standard and characterized by a center-to-center distance of 1.27 mm between neighboring conductors, the retention being ensured by the male contact, the female connector being a tube. This is a family of male and female rectangular connectors, the connecting portions of which have a D shape.

In one advantageous embodiment of the present invention, the 3 central strands of the bundle of the contact according to the present invention are made of copper and the contact according to the invention has a magnetism value <1 nT according to the GFSC-S-311 standard. This feature becomes important in electronics in many applications, especially in offshore or subterranean exploration.

Thus, the present invention also relates to the use of the male electrical contact according to the invention, in which the 3 central strands of the bundle are made of copper, for offshore or subterranean exploration applications.

The present invention will be better understood on reading the description of the figures and examples that follow, which are given by way of nonlimiting indication.

FIG. 1 represents a perspective diagram of an example of a 15-point female micro-D connector according to the MIL-DTL-83513 standard.

FIG. 2 represents a schematic side view of a male electrical contact of twist-pin type 1 comprising a bundle 2 provided with a bulge or bump 3 in the central portion, the bundle forming the electrical terminal. This electrical terminal is inserted into a cylinder 4 which is provided with an electrical wire 5.

Figure 3:
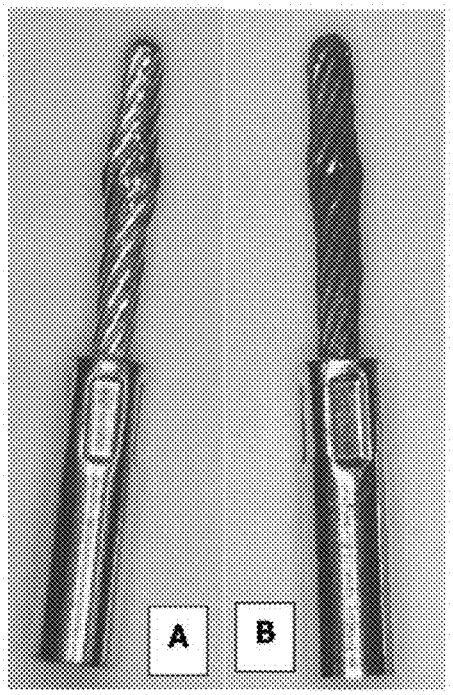

FIG. 3 represents a photo of a male electrical contact of twist-pin type without an electrical wire according to FIG. 2, of which the 3 central strands of the bundle are made of Cu and the 7 peripheral strands are made of CuBeCo alloy, before residence time in an oven (FIG. 3A) and after residence time in an oven at 260° C. under ambient atmosphere for 100 hours of mating with a female contact (FIG. 3B) (comparative example 1).

Figure 4:
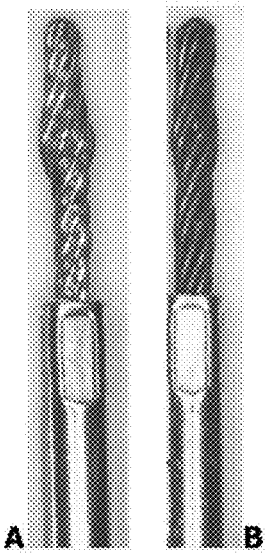

FIG. 4 represents a photo of a male electrical contact of twist-pin type without an electrical wire according to FIG. 2, of which the 3 central strands of the bundle are made of Cu and the 7 peripheral strands are made of Cu—Ni—Sn—Mn alloy, before residence time in an oven (FIG. 4A) and after residence time in an oven at 260° C. under ambient atmosphere for 100 hours of mating with a female contact (FIG. 4B) (comparative example 2).

Figure 5:
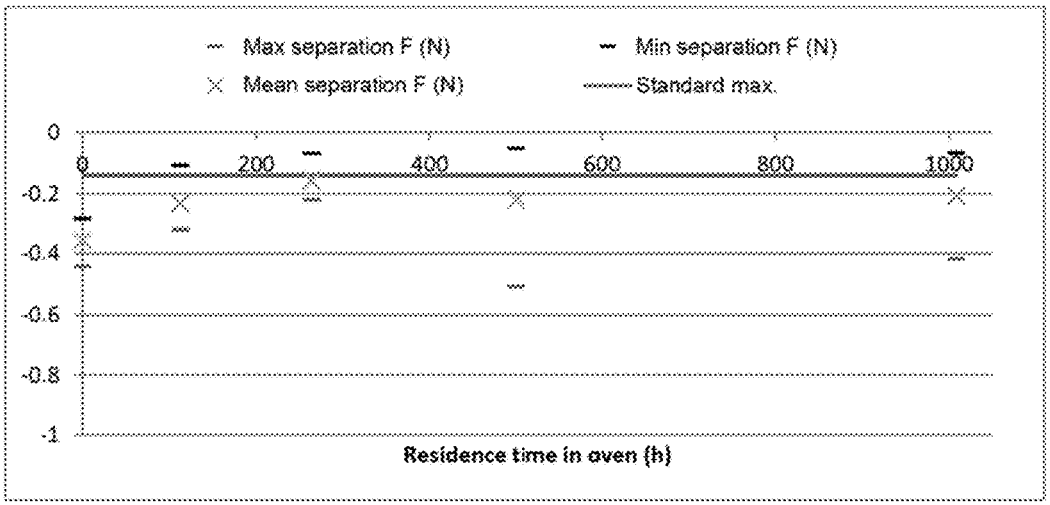

FIG. 5 represents the measurement in accordance with the MIL-DTL-83513 standard on 10 male electrical contacts of twist-pin type according to FIG. 2, of which the 3 central strands of the bundle are made of Cu and the 7 peripheral strands are made of Cu—Ni—Sn—Mn alloy, of the separation force in N (Fmax, Fmin and Fmean) as a function of the residence time in an oven (h: hour) at 260° C. under ambient atmosphere, compared to the minimum force, as absolute value, required according to the MIL-DTL-83513 standard (standard max.) (comparative example 2).

Figure 6:
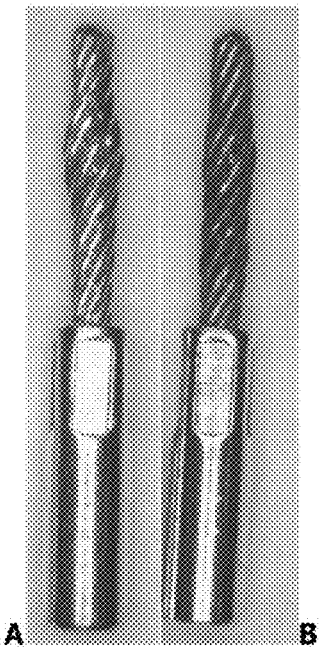

FIG. 6 represents a photo of a male electrical contact of twist-pin type without an electrical wire according to FIG. 2, of which the 3 central strands and the 7 peripheral strands of the bundle are made of Au—Cu—Pt—Ag—Zn alloy, before residence time in an oven (FIG. 6A) and after residence time in an oven at 260° C. under ambient atmosphere for 100 hours of mating with a female contact (FIG. 6B) (comparative example 3).

Figure 7:
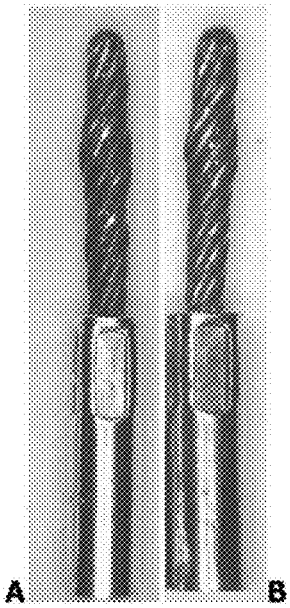

FIG. 7 represents a photo of a male electrical contact of twist-pin type without an electrical wire according to FIG. 2, of which the 3 central strands of the bundle are made of Ni and the peripheral strands are made of Ni—Cr20-Co18-Ti—Al alloy, before residence time in an oven (FIG. 7A) and after residence time in an oven at 260° C. under ambient atmosphere for 2000 hours of mating with a female contact (FIG. 7B) (example 1).

Figure 8:
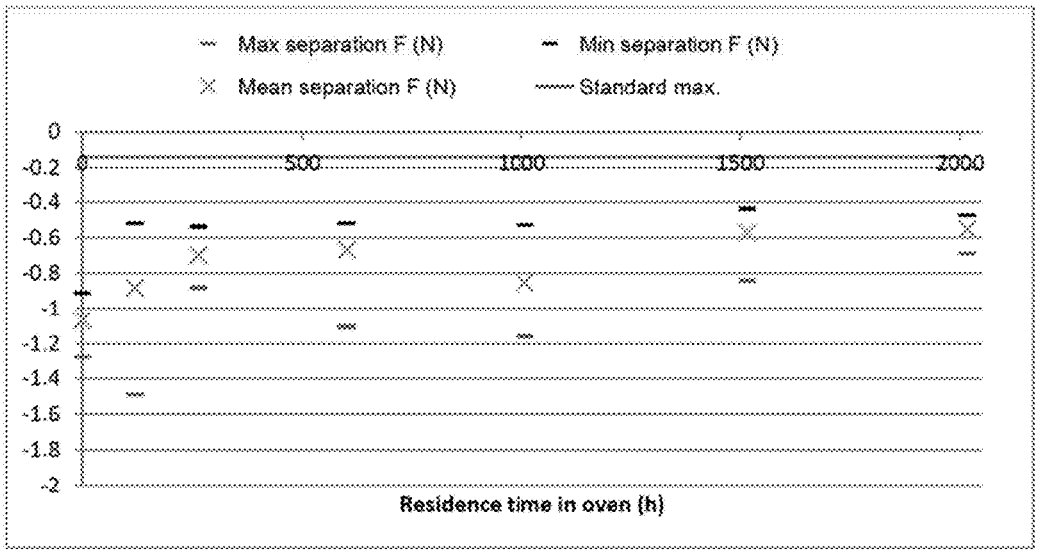

FIG. 8 represents the measurement in accordance with the MIL-DTL-83513 standard on 10 male electrical contacts of twist-pin type according to FIG. 2, of which the 3 central strands of the bundle are made of Ni and the peripheral strands are made of Ni—Cr20-Co18-Ti—Al alloy, of the separation force (Fmax, Fmin and Fmean) as a function of the residence time in an oven (h: hour) at 260° C. under ambient atmosphere, compared to the minimum force, as absolute value, required according to the MIL-DTL-83513 standard (max. standard) (example 1).

Figure 9:
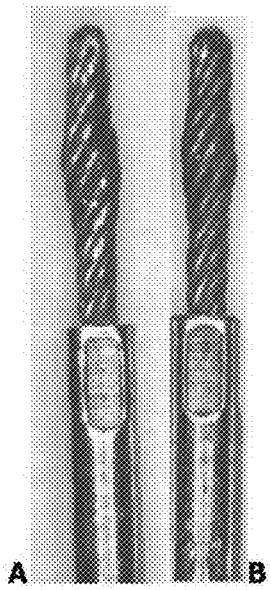

FIG. 9 represents a photo of a male electrical contact of twist-pin type without an electrical wire according to FIG. 2, of which the 3 central strands of the bundle are made of Cu and the peripheral strands are made of Ni—Cr20-Co18-Ti—Al alloy, before residence time in an oven (FIG. 9A) and after residence time in an oven at 260° C. under ambient atmosphere for 2000 hours of mating with a female contact (FIG. 9B) (example 5).

Figure 10:
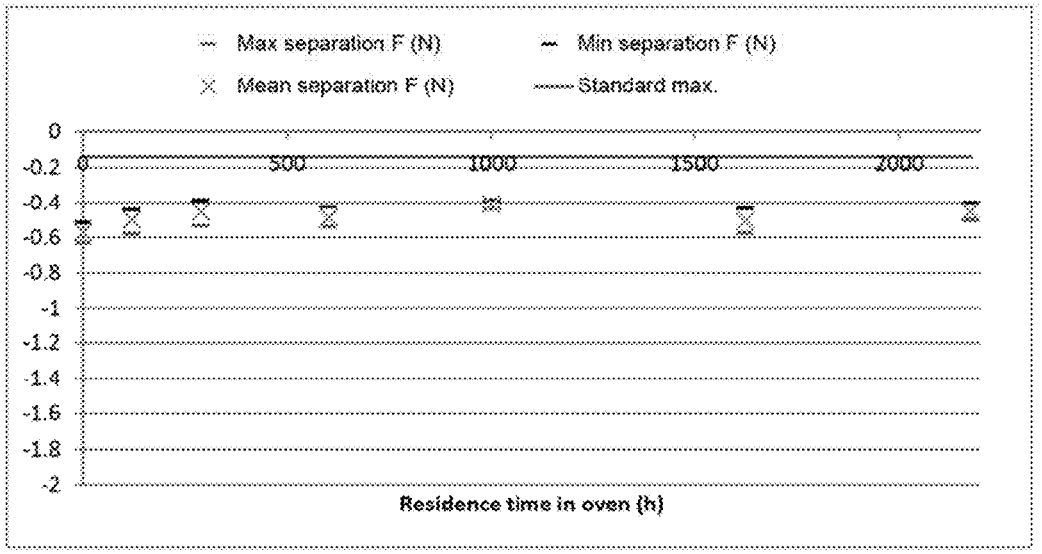

FIG. 10 represents the measurement in accordance with the MIL-DTL-83513 standard on 10 male electrical contacts of twist-pin type according to FIG. 2, of which the 3 central strands of the bundle are made of Cu and the peripheral strands are made of Ni—Cr20-Co18-Ti—Al alloy, of the separation force (Fmax, Fmin and Fmean) as a function of the residence time in an oven (h: hour) at 260° C. under ambient atmosphere, compared to the minimum force, as absolute value, required according to the MIL-DTL-83513 standard (max. standard) (example 5).

Figure 11:
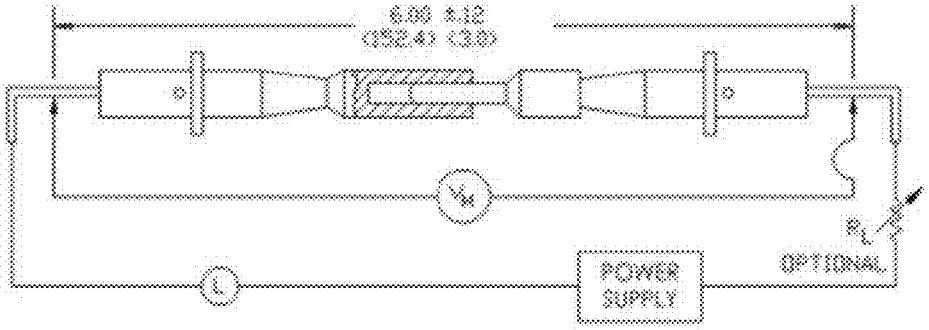

FIG. 11 represents the wiring diagram for the measurement of the contact resistance according to the MIL-DTL-83513 standard (example 6).

Figure 12:
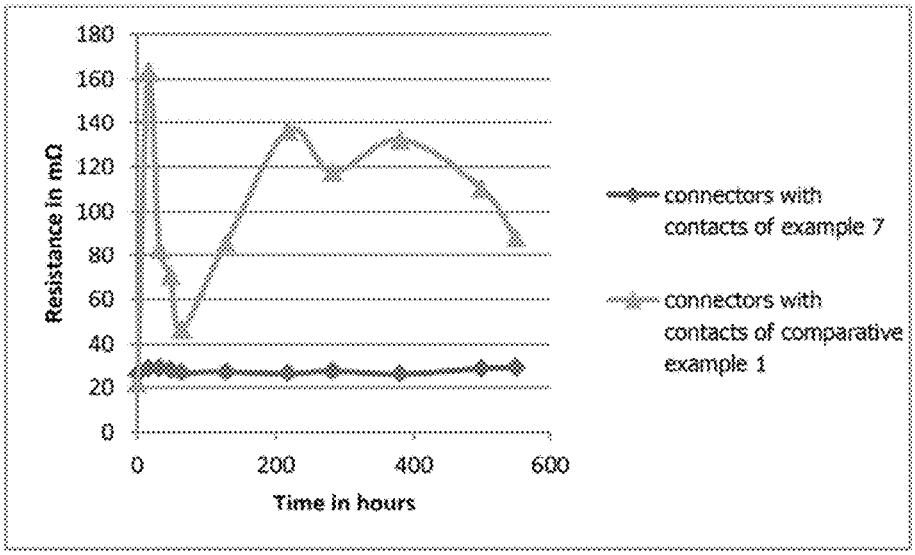

FIG. 12 represents the change in the values of low-intensity contact resistance in mOhm (measured at ambient temperature with the device from FIG. 11) with the time (in hours) that the male connector spent in the oven at 260° C., mated to a female connector, for a connector according to the invention (with Cu and Ni—Cr20-Co18-Ti—Al bundle contact according to example 7) and a connector from the prior art (with Cu and Cu—Be—Co bundle contacts according to comparative example 1) (example 9).

EXAMPLES

Comparative Example 1 (Cu and Cu—Be—Co Bundle)

TP contacts composed of 3 central strands (diameter=0.089 mm) made of copper and 7 peripheral strands (diameter=0.127 mm) made of copper, beryllium and cobalt alloy (Cu—Be—Co: Cu—Be1.8-Co0.2), from the company NGK, (reference Berylco 25) are produced. The mechanical features of the alloy are listed in table 1 below:

TABLE 1

| | Composition | Rm (MPa) | Rp0.2% (MPa) | E (GPa) | A (%) | Conductivity (% IACS) |
|---|---|---|---|---|---|---|
| Comparative example 1 | Cu—Be1.8—Co0.2 | 1260-1450 | 1090-1350 | 130 | 1 | 19-28 |

The three central strands of the bundle are assembled with a 2 mm left pitch, then the seven strands around are assembled with a 2.4 mm right pitch. The tube is made of copper. The TP contacts are then inserted into female contacts having an internal diameter of 0.573 mm. The aging takes place at 260° C. under ambient atmosphere for 100 hours on 10 pairs of contacts. Visual observation shows that the bump of the contact is shrunk after aging (FIG. 3). After aging, the shrinkage of the bump is observed visually on these contacts and the insertion force in a 0.561 mm diameter gauge and the separation force of the contacts in a 0.584 mm diameter gauge according to the MIL-DTL-83513G standard are measured. The results are listed in table 2 below:

TABLE 2

| | | t in the oven (hours) | |
|---|---|---|---|
| | | 0 | 100 |
| Comparative example 1 | Mean engagement force (N) | 1.14 | 0.27 |
| | Mean separation force (N) | −0.49 | −0.07 |

The engagement force is divided by 4 when the values before and after residence time in the oven are compared, the separation force is divided by 7. The MIL-DTL-83513G standard stipulates a maximum insertion force of 1.67 N and a minimum separation force of 0.14 N, as absolute value. The separation values obtained after 100 h at 260° C. are therefore below the limit of the standard.

In conclusion, this contact cannot be used for applications at 260° C.

Comparative Example 2 (Cu and Cu—Ni—Sn—Mn Bundle)

TP contacts similar to those of comparative example 1 are produced, but using, for the 7 peripheral strands, a copper, nickel, tin and manganese alloy (Cu—Ni—Sn—Mn: Cu—Ni13-Sn7-Mn0.15) from the company Berda (reference Nibrodal 138), the features of which are found in table 3 below.

TABLE 3

| | Composition | Rm (MPa) | Rp0.2% (MPa) | E (GPa) | A (%) | Conductivity (% IACS) |
|---|---|---|---|---|---|---|
| Comparative example 2 | Cu—Ni13—Sn7—Mn0.15 | 1309-1337 | | 119 | 0.6-1 | 8.4 |

The thermal aging is carried out at 260° C. under conditions similar to comparative example 1. After aging, the visual observation and the measurement of the insertion and separation forces are performed, as in comparative example 1. The results are listed in table 4 below.

TABLE 4

| | | t in the oven (hours) | | | | |
|---|---|---|---|---|---|---|
| | | 0 | 113 | 264 | 500 | 1008 |
| Comparative example 2 | Mean engagement force (N) | 0.76 | 0.55 | 0.48 | 0.66 | 0.48 |
| | Mean separation force (N) | −0.36 | −0.23 | −0.16 | −0.22 | −0.21 |

The bumps of the contacts are flattened and a small bulge appears at the rear of the contact (FIG. 4). The mean forces obtained, presented in table 4, meet the standard, but the scattering thereof means that some of the contacts do not meet it (FIG. 5). Thus, a conclusion similar to comparative example 1 is reached, namely that this contact cannot be used for applications at 260° C.

Comparative Example 3 (Au—Cu—Pt—Ag—Zn Bundle)

TP contacts similar to those of comparative examples 1 and 2 are produced, but using, for the 3 central strands and 7 peripheral strands, an Au—Cu—Pt—Ag—Zn alloy (Au71.5-Cu14.5-Pt8.5-Ag4.5-Zn1) from the company Texpart, the features of which are found in table 5 below.

TABLE 5

| | Composition | Rm (MPa) | Rp0.2% (MPa) | E (GPa) | A (%) | Conductivity (% IACS) |
|---|---|---|---|---|---|---|
| Comparative example 3 | Au71.5—Cu14.5—Pt8.5—Ag4.5—Zn1 | 1030-1380 | 900 | 110 | 2 | 12.2 |

The thermal aging is carried out at 260° C. under the same conditions as for comparative examples 1 and 2. After aging, the visual observation and the measurement of the insertion and separation forces are performed, as in the 2 abovementioned comparative examples. The results are listed in table 6 below.

TABLE 6

| | | t in the oven (hours) | |
|---|---|---|---|
| | | 0 | 100 |
| Comparative example 3 | Mean engagement force (N) | 1.47 | 0.49 |
| | Mean separation force (N) | −0.59 | −0.12 |

The bumps are also flattened (FIG. 6). The force results show that the separation forces are on average below the standard. Thus, the conclusion similar to the preceding 2 comparative examples is reached, namely that this contact cannot be used for applications at 260° C.

Example 1 (Ni and Ni—Cr20-Co18-Ti—Al (UNS N07090) Bundle—Mechanical Aspect)

TP contacts of similar construction to the preceding comparative examples are produced, but using 3 central strands made of nickel and 7 peripheral strands made of Ni—Cr20-Co18-Ti—Al alloy available from the company Alloy Wire International under the reference Nimonic 90, of which the features are found in table 7 below and the exact composition is found in table 8 below.

TABLE 7

| | Composition | Rm (MPa) | Rp0.2% (MPa) | E (GPa) | A (%) | Conductivity (% IACS) |
|---|---|---|---|---|---|---|
| Example 1 | Ni—Cr20—Co18—Ti—Al | 1500-1800 | | 213-240 | | 1.5 |

TABLE 8

| | DIN | UNS | Composition (in %) | | | | |
|---|---|---|---|---|---|---|---|
| | | | Ni | Co | Cr | Ti | Al |
| Example 1 | Ni—Cr20—Co18—Ti—Al | N07090 | 54 | 15-21 | 18-21 | 2-3 | 1-2 |

These TP contact-female contact pairs are subjected to thermal aging at 260° C. under ambient atmosphere for 2000 hours. In this example, 60 pairs were tested. After aging, as in the preceding comparative examples, the TP contact is taken back out of the female contact and the visual observation and the measurement of the insertion and separation forces are performed. The results are listed in table 9 below.

TABLE 9

| | | t in the oven (hours) | | | | | | |
|---|---|---|---|---|---|---|---|---|
| | | 0 | 120 | 264 | 600 | 1008 | 1516 | 2016 |
| Example 1 | Mean engagement force (N) | 1.79 | 2.10 | 1.34 | 1.49 | 1.45 | 1.38 | 1.19 |
| | Mean separation force (N) | −1.07 | −0.89 | −0.70 | −0.67 | −0.85 | −0.57 | −0.55 |

Visually, the contacts retain their bump (FIG. 7). No difference is seen between the contacts before and after aging.

The forces obtained, presented in table 9, show that even after 2000 h of aging, the mean separation force is greater, as absolute value, than that imposed by the standard. Furthermore, all the contacts meet this standard and not only the average. This is shown in FIG. 8. Consequently, it can be concluded that these TP contacts, unlike the preceding 3 comparative examples, can be used for applications at 260° C., since the separation forces of these contacts meet the MIL-DTL-83513 standard after residence time of 2000 h in the oven.

Example 2 (Ni and Ni—Cr20-Ti—Al (UNS N07080) Bundle—Mechanical Aspect)

TP contacts of similar construction to the preceding example 1 are produced, but with 7 peripheral strands made of Ni—Cr20-Ti—Al alloy available from the company Alloy Wire International under the reference Nimonic 80A, of which the features are found in table 10 below and the exact composition is found in table 11 below.

TABLE 10

| | Composition | Rm (MPa) | Rp0.2% (MPa) | E (GPa) | A (%) | Conductivity (% IACS) |
|---|---|---|---|---|---|---|
| Example 2 | Ni—Cr20—Ti—Al | 1500-1800 | | 222 | | 1.3 |

TABLE 11

| | DIN | UNS | Composition (in %) | | | | |
|---|---|---|---|---|---|---|---|
| | | | Ni | Co | Cr | Ti | Al |
| Example 2 | Ni—Cr20—Ti—Al | N07080 | 72.5-79.2 | <2 | 18-21 | 1.8-2.7 | 1-1.8 |

The TP contact-female contact pairs are subjected to the same aging as above. In this example, 10 pairs were tested. After aging, as in example 1 and the preceding comparative examples, the TP contact is taken back out of the female contact and the visual observation and the measurement of the insertion and separation forces are performed.

Visually, the contacts retain their bump as in the preceding example 1. Furthermore, the separation forces obtained are similar to the preceding example 1. They are listed in table 11a below:

TABLE 11a

| | | before oven | after 2005 h at 260° C. |
|---|---|---|---|
| Example 2 | Mean separation F (N) | −0.66 | −0.59 |
| | Mean engagement F (N) | 1.55 | 1.33 |

Consequently, this construction may also be used for applications at 260° C.

Example 3 (Ni and Ni—Cr20-Co14-Mo—Ti—Al (UNS N07001) Bundle—Mechanical Aspect)

TP contacts of similar construction to the preceding examples 1 and 2 are produced, but with 7 peripheral strands made of Ni—Cr20-Co14-Mo—Ti—Al alloy available from the company Alloy Wire International under the reference Waspaloy, of which the features are found in table 12 below and the exact composition is found in table 13 below.

TABLE 12

| | Composition | Rm (MPa) | Rp0.2% (MPa) | E (GPa) | A (%) | Conductivity (% IACS) |
|---|---|---|---|---|---|---|
| Example 3 | Ni—Cr20—Co14—Mo—Ti—Al | 1300-1500 | | 211 | | 1.4 |

TABLE 13

| | DIN | UNS | Composition (in %) | | | | | | |
|---|---|---|---|---|---|---|---|---|---|
| | | | Ni | Co | Cr | Ti | Al | Mo | Fe |
| Example 3 | NiCr20Co14MoTiAl | N07001 | 56.7-58.7 | 13.5 | 19 | 3 | 1.5 | 4.3 | <2 |

These TP contact-female contact pairs are subjected to thermal aging at 260° C. under ambient atmosphere for 2000 hours. In this example, 10 pairs were tested. After aging, as in the preceding examples 1 and 2, the TP contact is taken back out of the female contact and the visual observation and the measurement of the insertion and separation forces are performed.

Visually, the contacts retain their bump as in the preceding examples 1 and 2. Furthermore, the separation forces obtained are also similar to the preceding examples 1 and 2. They are listed in table 13a below:

TABLE 13a

| | | before oven | after 2005 h at 260° C. |
|---|---|---|---|
| Example 3 | Mean separation F (N) | −1.06 | −0.59 |
| | Mean engagement F (N) | 1.75 | 1.44 |

Consequently, this construction may also be used for applications at 260° C.

Example 4 (Ni and Ni—Cr19-Co11-Mo—Ti—Al (UNS N07041) Bundle—Mechanical Aspect)

TP contacts of similar construction to the preceding examples 1 to 3 are produced, but with 7 peripheral strands made of Ni—Cr19-Co11-Mo—Ti—Al alloy available from the company Alloy Wire International under the reference Rene 41, of which the features are found in table 14 below and the exact composition is found in table 15 below.

TABLE 14

| | Composition | Rm (MPa) | Rp0.2% (MPa) | E (GPa) | A (%) | Conductivity (% IACS) |
|---|---|---|---|---|---|---|
| Example 4 | Ni—Cr19—Co11—Mo—Ti—Al | 1600-2000 | | 218 | | 1.3 |

TABLE 15

| | DIN | UNS | Composition (in %) | | | | | |
|---|---|---|---|---|---|---|---|---|
| | | | Ni | Co | Cr | Ti | Al | Mo |
| Example 4 | NiCr19Co11MoTiAl | N07041 | 52.6-56.6 | 12 | 18-20 | 3-3.3 | 1.4-1.6 | 9-10.5 |

The TP contact-female contact pairs are subjected to the same aging as above. In this example, 10 pairs were tested. After aging, as in the preceding examples 1 to 3, the TP contact is taken back out of the female contact and the visual observation and the measurement of the insertion and separation forces are performed. Visually, the contacts retain their bump as in the preceding examples 1-3. Furthermore, the separation forces obtained are also similar to the preceding examples 1-3. They are listed in table 15a below:

TABLE 15a

| | | before oven | after 2005 h at 260° C. |
|---|---|---|---|
| Example 4 | Mean separation F (N) | −1.08 | −0.50 |
| | Mean engagement F (N) | 1.84 | 1.11 |

Consequently, this construction may also be used for applications at 260° C.

Subsequently, the construction using the Ni—Cr20-Co18-Ti—Al alloy from example 1 for the 7 peripheral strands was concentrated on, but similar results may be obtained with the 3 other alloys used for the 7 peripheral strands from examples 2-4.

Example 5 (Cu and Ni—Cr20-Co18-Ti—Al Bundle—Mechanical Aspect)

TP contacts of similar construction to the preceding examples 1-4 are produced, but using 3 central strands made of copper and 7 peripheral strands made of Ni—Cr20-Co18-Ti—Al alloy available from the company Alloy Wire International under the reference Nimonic 90, of which the features are found in table 7 above and the exact composition is found in table 8 above. TP contact-female contact pairs are subjected to thermal aging at 260° C. under ambient atmosphere for 2000 hours. After aging, as in the preceding examples 1-4, each TP contact is taken back out of the female contact and the visual observation and the measurement of the insertion and separation forces are performed. The results are listed in table 16 below.

TABLE 16

| | | t in the oven (hours) | | | | | | |
|---|---|---|---|---|---|---|---|---|
| | | 0 | 120 | 288 | 600 | 1000 | 1624 | 2176 |
| Example 5 | Mean engagement force (N) | 1.07 | 1.03 | 0.88 | 0.88 | 0.99 | 1.02 | 0.99 |
| | Mean separation force (N) | −0.57 | −0.50 | −0.45 | −0.49 | −0.41 | −0.50 | −0.45 |

Visually, the contacts retain their bump (FIG. 9). No difference is seen between the contacts before and after aging. The forces obtained, presented in table 16, show that even after 2000 h of aging, the mean separation force is greater, as absolute value, than that imposed by the standard. Furthermore, all the contacts meet this standard and not only the average. This is represented visually in FIG. 10. Furthermore, the standard deviations obtained are very low for this example compared to the preceding ones. Consequently, this construction may also be used for applications at 260° C.

Example 6 (Ni and Ni—Cr20-Co18-Ti—Al Bundle—Contact Resistance)

Sub-Example 6a (Gold Coating Thickness=1.3 μm)

TP contacts of similar construction to example 1 are produced, on which a surface treatment is additionally applied. The surface treatment consists of an electrolytic gold coating having a thickness of around 1.3 μm. Contact resistance measurements are carried out according to the wiring diagram presented in FIG. 11, as specified in the MIL-DTL-83513 standard. The values given between parentheses are in mm. A wire of AWG26 gauge was used for the wiring. The test is carried out at ambient temperature, for two set intensities. The latter and the conditions to be met according to the standard are presented in table 17 below.

TABLE 17

| | Test conditions | Condition to be met |
|---|---|---|
| Contact resistance | L = 2.5 A | Vm < 65 mV |
| Low intensity contact resistance | L = 100 mA | R < 28 mohm |

The results obtained are presented in table 18 below.

TABLE 18

| Sample | Contact resistance (mV) | Low intensity contact resistance (mOhm) |
|---|---|---|
| 1 | 79.1 | 31.2 |
| 2 | 79.3 | 30.8 |
| 3 | 78.3 | 31.65 |
| 4 | 69 | 30.05 |
| 5 | 77.1 | 31.52 |
| 6 | 70.3 | 30.27 |
| 7 | 81.5 | 33.73 |

TABLE 18-continued

| Sample | Contact resistance (mV) | Low intensity contact resistance (mOhm) |
|---|---|---|
| 8 | 75.7 | 27.44 |
| 9 | 71.5 | 28.37 |
| 10 | 68.9 | 28.56 |
| mean | 75.1 | 30.36 |

The mean values obtained for the two measurements are above the values set by the standard.

Sub-Example 6b (Gold Coating Thickness=2 μm)

TP contacts of identical construction to the preceding sub-example 6a are produced, but with an electrolytic gold coating having a thickness of around 2 μm. The same tests were carried out as in the preceding sub-example 6a. The results are presented in table 19 below.

TABLE 19

| Sample | Contact resistance (mV) | Low intensity contact resistance (mOhm) |
|---|---|---|
| 1 | 69.5 | 24.12 |
| 2 | 73.3 | 27.04 |
| 3 | 54.5 | 26.77 |
| 4 | 73.7 | 31.77 |
| 5 | 71.2 | 27.45 |
| 6 | 69.2 | 27.57 |
| 7 | 55.3 | 27.14 |
| 8 | 68.5 | 27.96 |
| 9 | 69.3 | 27.42 |
| 10 | 72.2 | 30.54 |
| mean | 67.7 | 27.78 |

The values are still above the standard, but are closer thereto than the contacts of the preceding sub-example 6a. This shows that the contact resistance may move closer to the values of the standard by increasing the thickness of gold deposited.

Sub-Example 6c (Gold Coating Thickness=2.7 μm)

TP contacts of identical construction to the preceding sub-examples 6a and 6b are produced, but with an electrolytic gold coating having a thickness of around 2.7 μm. The same tests were carried out as above. The results are presented in table 20 below.

TABLE 20

| Sample | Contact resistance (mV) | Low intensity contact resistance (mOhm) |
|---|---|---|
| 1 | 51.4 | 24.93 |
| 2 | 51.5 | 25.50 |
| 3 | 53.7 | 25.71 |
| 4 | 54 | 25.97 |
| 5 | 54.4 | 26.40 |
| 6 | 56.1 | 26.67 |
| 7 | 56.4 | 27.06 |
| 8 | 56.7 | 27.23 |
| 9 | 57.3 | 27.60 |
| 10 | 58.7 | 27.78 |
| mean | 55.0 | 26.49 |

The values obtained for the two types of measurement meet those defined by the standard. A gold thickness of 2.7 μm on the Ni and Ni—Cr20-Co18-Ti—Al contacts therefore makes it possible to comply with the standard when it comes to the contact resistances.

Example 7 (Cu and Ni—Cr20-Co18-Ti—Al Bundle—Contact Resistance)

A TP contact of similar construction to examples 5 is produced. An electrolytic gold coating having a thickness of around 2.6 μm is also produced. The same tests were carried out as in the preceding sub-examples 6a-6c. The results are presented in table 21 below.

TABLE 21

| Sample | Contact resistance (mV) | Low intensity contact resistance (mOhm) |
|---|---|---|
| 1 | 47.9 | 28.89 |
| 2 | 48.7 | 27.52 |
| 3 | 50.5 | 25.76 |
| 4 | 57.5 | 23.96 |
| 5 | 52.9 | 27.12 |
| 6 | 53.6 | 26.85 |
| 7 | 50.6 | 29.02 |
| 8 | 48.0 | 28.27 |
| 9 | 50.0 | 30.37 |
| 10 | 48.0 | 26.87 |
| mean | 50.8 | 27.46 |

This solution shows that replacing the three nickel strands with more conductive copper strands makes it possible to significantly lower the contact resistance until the value of standard copper-beryllium contacts (52 mV) is achieved. As regards the low intensity contact resistance, the latter is affected very little by the change of material. But values close to the standard are obtained.

Example 8 (Cu and Ni—Cr20-Co18-Ti—Al Bundle—Amagnetic Aspect)

On the contacts produced in example 5, measurements of residual magnetism were carried out according to the procedure defined in the GFSC-S-311 standard, using a three-dimensional magnetometer. Firstly, the initial magnetic field is measured. Next, the contacts are magnetized with a 500 mT field using a magnet. A new measurement of residual magnetic field is carried out. Lastly, a demagnetization phase is carried out by applying an alternating magnetic field having a value of greater than 500 mT. A measurement is again carried out. The three measurements revealed a residual magnetism of less than 1 nT, a critical value below which the contacts tested are considered to be amagnetic.

Example 9 (Comparison Between a Contact According to the Invention (Cu and Ni—Cr20-Co18-Ti—Al Bundle According to Example 7) and a Contact from the Prior Art (Cu and Cu-be-Co Bundle According to Comparative Example 1))

The change in the low intensity contact resistance values (in mOhm) with time (in hours) that the male connector spent in the oven at 260° C., mated to a female connector, was measured according to the wiring diagram presented in FIG. 11, as specified in the MIL-DTL-83513 standard at ambient temperature for the two types of contact. The connectors were unmated-remated 5 times before the contact resistance measurement.

A wire of AWG26 gauge was used for the wiring. The conditions of the test and the conditions to be met according to the standard are presented in table 17 of example 6.

The results are given in FIG. 12.

It is obvious that the connector produced with standard contacts of the prior art no longer ensures a good electrical contact, not least after about a hundred hours mated at 260° C.

The invention claimed is:

1. A male electrical contact of twist-pin type, comprising:

an electrical terminal formed by a bundle comprising three central strands made of copper and 7 peripheral strands made of Ni—Cr—Ti—Al alloy and a bulge in the central portion, the male electrical contact further including a cylinder and an electrical wire, an end of the electrical terminal being inserted into the cylinder, and the cylinder being provided with the electrical wire, wherein the Ni—Cr—Ti—Al alloy consists of, as a percentage by weight relative to a total weight of the alloy:

chromium: 15%-25%;

titanium: 1.5%-3.5%;

cobalt: 0-25%;

aluminum: 1%-2%;

molybdenum: 0-11%;

nickel: balance; and unavoidable impurities selected from the group consisting of Ag, B, Bi, C, Cu, Fe, Mn, P, Pb, S, Si, Zr and mixture thereof, wherein the three central strands made of copper are welded with the 7 peripheral strands made of Ni—Cr—Ti—Al alloy, wherein the three central strands are assembled with a pitch of between 1 and 5 mm left, and the 7 peripheral strands are assembled around with a pitch of between 1 and 5 mm right, wherein the bundle is coated with an electrolytic gold layer having a thickness of at least 2.6 μm, and wherein the male electrical contact is configured to transmit electric current.

2. The male electrical contact as claimed in claim 1, wherein the peripheral strands are helically wound around the central strands.

3. The male electrical contact as claimed in claim 1, wherein the content of nickel+cobalt, as a percentage by weight relative to the total weight of the alloy, is between 62% and 83%.

4. The male electrical contact as claimed in claim 3, wherein the content of nickel+cobalt, as a percentage by weight relative to the total weight of the alloy, is between 64.5% and 81.5%.

5. The male electrical contact as claimed in claim 1, wherein the cobalt is between 10% and 22% by weight relative to the total weight of the alloy.

6. The male electrical contact as claimed in claim 1, wherein the molybdenum is between 3.5% and 11% by weight relative to the total weight of the alloy.

7. The male electrical contact as claimed in claim 6, wherein the molybdenum is between 4% and 10.5% by weight relative to the total weight of the alloy.

8. The male electrical contact as claimed in claim 1, wherein the three central strands have a diameter of between 0.069 and 0.109 mm.

9. The male electrical contact as claimed in claim 8, wherein the three central strands have a diameter of 0.089 mm.

10. The male electrical contact as claimed in claim 1, wherein the seven peripheral strands have a diameter of between 0.1 and 0.160 mm.

11. The male electrical contact as claimed in claim 10, wherein the seven peripheral strands have a diameter of 0.127 mm.

12. The male electrical contact as claimed in claim 1, wherein the bundle comprises no sublayer between the alloy and the electrolytic gold layer.

13. The male electrical contact as claimed in claim 1, wherein a service temperature of the male electrical contact is ≤260° C.

14. The male electrical contact as claimed in claim 1, wherein a magnetism value of the male electrical contact is less than 1 nT.

15. A micro-D connector containing the male electrical contact as claimed in claim 1.

16. The male electrical contact as claimed in claim 1, wherein the Ni—Cr—Ti—Al alloy consists of, as percentage by weight relative to the total weight of the alloy:

chromium: 17%-22%;

titanium: 1.7%-3.4%;

cobalt: 2%-23%;

aluminum: 1.5%;

molybdenum 0-10.5%;

nickel: 50%-80%; and the unavoidable impurities selected from the group consisting of Ag, B, Bi, C, Cu, Fe, Mn, P, Pb, S, Si, Zr and mixture thereof.

17. The male electrical contact as claimed in claim 1, wherein the three central strands are assembled with a pitch of 2 mm left, and the seven peripheral strands are assembled around with a pitch of 2.4 mm right.

18. The male electrical contact as claimed in claim 1, wherein a contact resistance of the male electrical contact is within a limit defined by the Mil-DTL-83513 standard.

* * * * *